US012680033B2

(12) United States Patent
Leen et al.

(10) Patent No.: US 12,680,033 B2
(45) Date of Patent: Jul. 14, 2026

(54) SYSTEMS AND METHODS FOR PRODUCING WASH OIL

(71) Applicant: SABIC GLOBAL TECHNOLOGIES B.V., Bergen op Zoom (NL)

(72) Inventors: Steven Leen, Geleen (NL); Fabrice Cuoq, Geleen (NL); Daan Thijs, Geleen (NL); Recai Artan, Geleen (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 113 days.

(21) Appl. No.: 18/259,549

(22) PCT Filed: Nov. 18, 2021

(86) PCT No.: PCT/IB2021/060704
§ 371 (c)(1),
(2) Date: Jun. 27, 2023

(87) PCT Pub. No.: WO2022/144619
PCT Pub. Date: Jul. 7, 2022

(65) Prior Publication Data
US 2024/0059983 A1 Feb. 22, 2024

Related U.S. Application Data

(60) Provisional application No. 63/130,952, filed on Dec. 28, 2020.

(51) Int. Cl.
*C10G 45/72* (2006.01)
*C10G 45/00* (2006.01)

(52) U.S. Cl.
CPC ..... *C10G 45/72* (2013.01); *C10G 2300/4006* (2013.01); *C10G 2300/4012* (2013.01); *C10G 2300/802* (2013.01); *C10G 2400/30* (2013.01)

(58) Field of Classification Search
CPC ..... C10G 45/00; C10G 45/72
See application file for complete search history.

(56) References Cited

U.S. PATENT DOCUMENTS 2,534,025 A * 12/1950 Howes ..... C10G 7/00 208/143
3,492,220 A * 1/1970 Lempert et al. ..... C10G 45/36 208/210

(Continued)

FOREIGN PATENT DOCUMENTS

CN 101824336 2/2013
CN 103122260 5/2013

(Continued)

OTHER PUBLICATIONS

Al-Morished M.H. "Integrating refineries & petrochemical plants in the middle east", *17th World Petroleum Congress, Sep. 1-5, 2002, Rio de Janeiro, Brazil*, World Petroleum Congress, Sep. 1, 2002 (Abstract Only).

(Continued)

*Primary Examiner* — Tam M Nguyen
(74) *Attorney, Agent, or Firm* — Norton Rose Fulbright US LLP

(57) ABSTRACT

Systems and methods for producing a wash oil using a light fuel oil (e.g., cracked distillate) are disclosed. The methods include hydrogenating the cracked distillate and separating the hydrogenated cracked distillate to remove $C_4$ to $C_6$ hydrocarbons to produce the wash oil.

20 Claims, 2 Drawing Sheets

(56) References Cited

U.S. PATENT DOCUMENTS

| | | | | |
|---|---|---|---|---|
| 10,731,093 | B2 * | 8/2020 | Ouni | C11D 3/2075 |
| 2012/0006721 | A1 | 1/2012 | Nasuno | |
| 2017/0260464 | A1 | 9/2017 | Ouni et al. | |
| 2020/0385642 | A1 * | 12/2020 | Fickel | C10G 47/18 |

FOREIGN PATENT DOCUMENTS

| | | |
|---|---|---|
| CN | 105176583 | 12/2015 |
| CN | 105132019 | 9/2016 |
| CN | 105969422 | 9/2016 |
| CN | 106281448 | 1/2017 |
| CN | 107325840 | 11/2017 |
| CN | 109337714 | 2/2019 |
| EP | 3224339 | 1/2019 |
| WO | WO 2017/078902 | 5/2017 |
| WO | WO 2019/073455 | 4/2019 |

OTHER PUBLICATIONS

International Search Report issued in corresponding PCT Application No. PCT/IB2021/060704, dated Jan. 28, 2022.

Office Action issued in corresponding Chinese Application No. 202180092524.6, dated Jun. 27, 2025 (English Translation provided).

* cited by examiner

SYSTEMS AND METHODS FOR PRODUCING WASH OIL

CROSS REFERENCE TO RELATED APPLICATIONS

This application is a national phase under 35 U.S.C. § 371 of International Application No. PCT/IB2021/060704, filed Nov. 18, 2021, which claims the benefit of priority to U.S. Provisional Patent Application No. 63/130,952, filed Dec. 28, 2020, the entire contents of each of which are hereby incorporated by reference in their entirety.

FIELD OF INVENTION

The present invention generally relates to systems and methods for producing a wash oil. More specifically, the present invention relates to systems and methods for producing wash oil for compressors and soaking purposes using a light fuel oil as a feedstock.

BACKGROUND OF THE INVENTION

Wash oil is commonly used to remove fouling in equipment of chemical or oil production facilities. Generally, the quality specifications for wash oil are relatively stringent. More specifically, wash oil is required to be very "clean" having low gum content and high aromatics content. Therefore, commercially available wash-oils are generally expensive, increasing the cost for continuously removing fouling from equipment.

Overall, while the methods of producing wash oils exist, the need for improvements in this field persists in light of the aforementioned drawback with conventional systems and methods.

BRIEF SUMMARY OF THE INVENTION

A solution to the above-mentioned problem associated with the systems and methods of providing wash oil has been discovered. The solution resides in a method of using hydrogenated light fuel oil (e.g., a hydrogenated cracked distillate, a hydrogenated $C_9$+ hydrocarbon stream, and/or a hydrogenated $C_{10}$+ hydrocarbon stream) as a feedstock of wash oil that can be used for continuously removing fouling from equipment. This can be beneficial for at least reducing the cost of obtaining wash oil because the hydrotreated cracked distillate is a low cost feedstock for producing wash oil. Additionally, the method is capable of increasing the value of the light fuel oil such as the cracked distillate, which is conventionally a low value byproduct from steam cracking units that includes side draws of primary fractionators. Thus, the wash oil produced by the disclosed method can be used for continuously removing fouling in equipment. Therefore, the disclosed systems and methods of the present invention provide a technical solution to the problem associated with the conventional systems and methods for providing wash oil.

Embodiments of the invention include a method of processing a light fuel oil. The method comprises hydrogenating the light fuel oil to produce a hydrogenated light fuel oil. The method comprises separating, in a separation unit, the hydrogenated light fuel oil (hydrogenated pure light fuel oil or hydrogenated diluted light fuel oil) to produce a wash oil stream.

Embodiments of the invention include a method of processing a cracked distillate. The method comprises hydrogenating the cracked distillate and a diluent including pyrolysis gas in a hydrogenation unit to produce a hydrogenated intermediate stream. The method comprises separating, in a separation unit, the hydrogenated intermediate stream to remove $C_4$ to $C_8$ hydrocarbons from the hydrogenated intermediate stream to produce a wash oil stream configured to remove fouling, mainly for cracked gas compressor services.

Embodiments of the invention include a method of processing a cracked distillate. The method comprises hydrogenating the cracked distillate and a pyrolysis gas in a gasoline hydrogenation unit to saturate unsaturated hydrocarbons of the cracked distillate and produce a hydrogenated intermediate stream. The method comprises separating, in a separation unit comprising one or more distillation columns, the hydrogenated intermediate stream to remove $C_4$ to $C_8$ hydrocarbons from the hydrogenated intermediate stream to produce a wash oil stream configured to remove fouling from a cracked gas compressor.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refer to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, include any measurable decrease or complete inhibition to achieve a desired result.

The term "effective," as that term is used in the specification and/or claims, means adequate to accomplish a desired, expected, or intended result.

The term "light fuel oil," as that term is used in the specification and/or claims, means a hydrocarbon stream comprising primarily $C_{10}$+ hydrocarbons.

The term "cracked distillate," as that term is used in the specification and/or claims means a stream obtained at a mid to top portion of a primary fractionator of a liquid steam cracker.

The term "wash oil," as that term is used in the specification and/or claims means a hydrocarbon stream containing more than 90 wt. % of aromatics and having a boiling point above 300° C.

The term "$C_n$+ hydrocarbon" wherein n is a positive integer, e.g. 1, 2, 3, 4, or 5, as that term is used in the specification and/or claims, means any hydrocarbon having at least n number of carbon atom(s) per molecule.

The term "$C_n$− hydrocarbon" wherein n is a positive integer, e.g. 1, 2, 3, 4, or 5, as that term is used in the specification and/or claims, means any hydrocarbon having at most n number of carbon atom(s) per molecule.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

The term "primarily," as that term is used in the specification and/or claims, means greater than any of 50 wt. %, 50 mol. %, and 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which.

DETAILED DESCRIPTION OF THE INVENTION

Currently, wash oils used in chemical plants generally have low gum content and high aromatic content to ensure good quality. Thus, the conventional wash oils usually are expensive to produce. Using these conventional wash oils for removing fouling can considerably increase the overall cost for various chemical and/or oil production processes. Thus, conventional wash oils are used for intermittent washing. The present invention provides a solution to this problem. The solution is premised on a method of processing a light fuel oil including a cracked distillate. The method comprises hydrogenating the light fuel oil (e.g., cracked distillate) and separating the hydrogenated light fuel oil (e.g., cracked distillate) to produce the wash oil. This can be beneficial as the disclosed methods use conventionally low valued light fuel oils such as cracked distillate as a feedstock, thereby reducing the cost for obtaining the wash oil and increasing the overall value of cracked distillate. Additionally, due to low cost for the light fuel oil, the wash oil produced by the disclosed method can be used for continuous removing of fouling from equipment. These and other non-limiting aspects of the present invention are discussed in further detail in the following sections.

A. System for Producing Wash Oil

Figure 1:
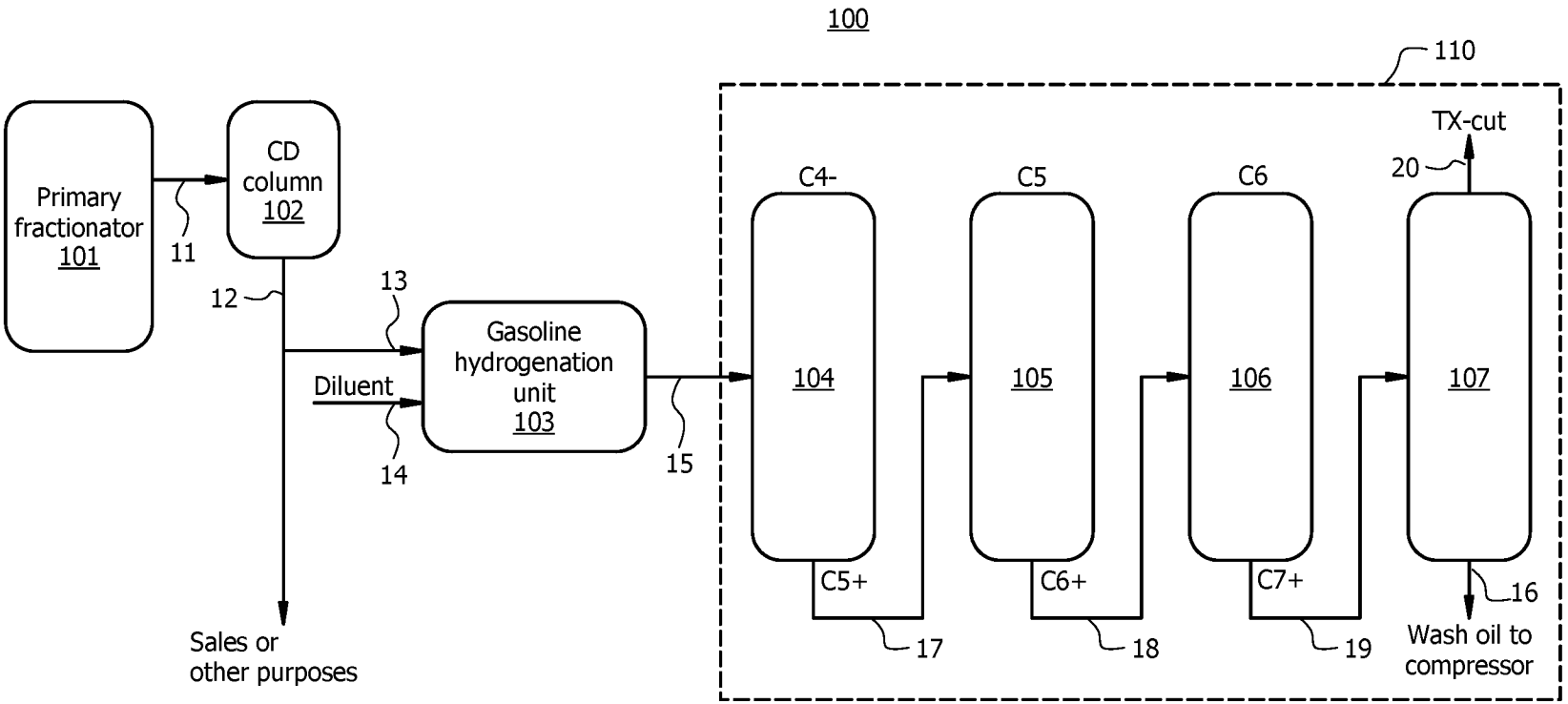
FIG. 1 shows a schematic diagram of a system for producing a wash oil, according to embodiments of the invention.

In embodiments of the invention, the system for processing a light fuel oil (e.g., a cracked distillate) is capable of reducing the wash oil cost for removing fouling from equipment including a compressor and/or a heat exchanger, soaking fouled equipment, and/or flushing fouled equipment, compared to using a conventional commercial wash oil. With reference to FIG. 1, a schematic diagram is shown for system 100, which is used for processing a light fuel oil (e.g., a cracked distillate) to produce a wash oil.

According to embodiments of the invention, system 100 includes primary fractionator 101 configured to separate a product stream from a steam cracker to produce first stream 11. First stream 11 may comprise cracked distillate, (indene, methyl) naphthalene, methyl(indene), dimethylethylbenzene, methylstyrene, or combinations thereof. In embodiments of the invention, primary fractionator 101 can include one or more distillation columns.

According to embodiments of the invention, one of the outlets of primary fractionator is in fluid communication with an inlet of cracked distillate column 102 such that first stream 11 flows from primary fractionator 101 to cracked distillate column 102. Cracked distillate column 102 can be configured to separate first stream 11 to produce cracked distillate stream 12 comprising primarily $C_{10}$+ hydrocarbons. Cracked distillated column 102 can include a distillation column. In embodiments of the invention, cracked distillate column 102 is further configured to remove light end of the cracked distillate by using a stripping gas.

According to embodiments of the invention, an outlet of cracked distillate column 102 is in fluid communication with an inlet of hydrogenation unit 103 such that at least a portion of cracked distillate stream 12, which forms cracked distillate portion 13, flows from cracked distillate column 102 to hydrogenation unit 103. In embodiments of the invention, hydrogenation unit 103 is configured to hydrogenate unsaturated hydrocarbons and/or remove gum forming compounds from cracked distillate portion 13 and/or a diluent stream to produce hydrogenated intermediate stream 15. The diluent stream can be configured to reduce negative impact of heavy components and/or contaminants of cracked distillate portion 13 on catalyst of hydrogenation unit 103. In embodiments of the invention, the diluent stream can include (1) pygas stream 14 including pyrolysis gasoline, and/or (2) another hydrocarbon recycle stream from another chemical plant. In embodiments of the invention, hydrogenation unit 103 can include a multistage hydrogenation unit. Hydrogenated intermediate stream 15 may comprise less than 40 wt. % unsaturated hydrocarbons and/or gum forming compounds. In embodiments of the invention, hydrogenation unit 103 includes a gasoline hydrogenation unit. Hydrogenation unit 103 can include a hydrogenation catalyst comprising nickel, palladium, molybdenum, cobalt, or combinations thereof.

According to embodiments of the invention, an outlet of gasoline hydrogenation unit 103 is in fluid communication with an inlet of separation unit 110 such that hydrogenated intermediate stream 15 flows from hydrogenation unit 103 to separation unit 110. In embodiments of the invention, separation unit 110 is configured to separate intermediate stream 15 to produce wash oil stream 16 comprising at least 90 wt. % aromatics.

In embodiments of the invention, separation unit 110 includes $C_4$ column 104 configured to separate $C_4$− hydrocarbons from hydrogenated intermediate stream 15 to produce $C_5$+ stream 17 comprising $C_5$+ hydrocarbons. An outlet of $C_4$ column 104 can be in fluid communication with an inlet of $C_5$ column 105 such that $C_5$+ stream 17 flows from $C_4$ column 104 to $C_5$ column 105. In embodiments of the invention, $C_5$ column 105 is configured to separate $C_5$ hydrocarbons from $C_5$+ hydrocarbons to produce $C_6$+ stream 18 comprising $C_6$+ hydrocarbons. An outlet of $C_5$ column 105 can be in fluid communication with an inlet of $C_6$ column 106 such that $C_6$+ stream 18 flows from $C_5$ column 105 to $C_6$ column 106. In embodiments of the invention, $C_6$ column 106 is configured to separate $C_6$ hydrocarbons from $C_6$+ stream 18 to form $C_7$+ stream 19 comprising primarily $C_7$+ hydrocarbons. According to embodiments of the invention, an outlet of $C_6$ column 106 is in fluid communication with an inlet of $C_5$ column 107 such that $C_7$+ stream 19 flows from $C_6$ column 106 to $C_5$ column 107. In embodiments of the invention, $C_5$ column 107 is configured to separate $C_7$ to $C_8$ fraction from $C_7$+ stream 19 to produce wash oil stream 16 comprising the wash oil, and $C_7$ to $C_8$ fraction stream 20 comprising primarily toluene, xylenes (p-, m-, o-), and ethylbenzene, collectively.

B. Method for Processing Cracked Distillate to Produce Wash Oil

Figure 2:
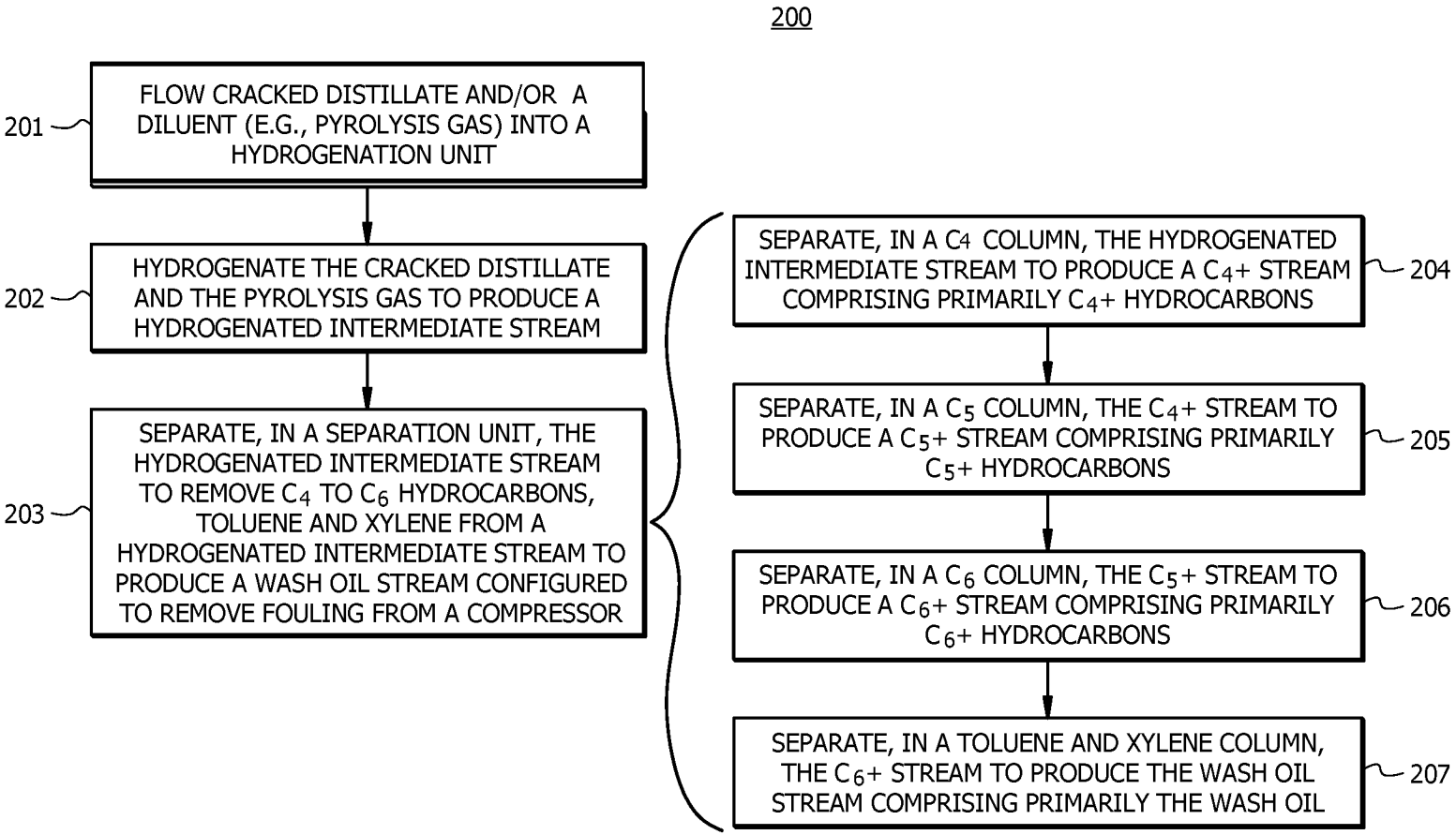
FIG. 2 shows a schematic flowchart of a method for producing a wash oil, according to embodiments of the invention.

In embodiments of the invention, a method of processing a light fuel oil (e.g., cracked distillate) to produce wash oil is described. As shown in FIG. 2, embodiments of the invention include method 200 for processing cracked distillate for producing wash oil with reduced cost compared to conventional wash oil. Method 200 may be implemented by system 100, as shown in FIG. 1 and described above.

According to embodiments of the invention, as shown in block 201, method 200 includes flowing a light fuel oil stream (e.g., cracked distillate of cracked distillate portion 13) and/or the diluent (e.g., pyrolysis gas of pygas stream 14) into hydrogenation unit 103. In embodiments of the invention, the cracked distillate and the pyrolysis gas stream are flowed into the hydrogenation unit at a weight flow rate ratio of 1:80 to 1:50 and all ranges and values there between including ranges of 1:80 to 1:70, 1:70 to 1:60, and 1:60 to 1:50. In embodiments of the invention, the cracked distillate is produced via distillate take-off on mid-top of primary fractionator. Pygas stream 14 may be produced via condensation of cracked gas in quench water tower and compressor interstage sections. The cracked distillate comprises primarily $C_{10}$+ hydrocarbons. The pyrolysis gas comprises primarily $C_4$ to $C_{10}$ hydrocarbons.

According to embodiments of the invention, as shown in block 202, method 200 includes hydrogenating the light fuel oil stream (e.g., cracked distillate of cracked distillate portion 13) and the diluent (e.g., pyrolysis gas of pygas stream 14) to produce hydrogenated intermediate stream 15. Hydrogenated intermediate stream 15 may comprises less than 0.5 wt. % reactive molecules. Non-limiting examples of the reactive molecules can include an indene, a styrene, dicyclopentadiene (DCPD), or combinations thereof. Hydrogenated intermediate stream 15 can include 60 to 80 wt. % aromatics. In embodiments of the invention, hydrogenating at block 202 is performed under reaction conditions including a reaction temperature of 50 to 175° C. and all ranges and values there between including ranges of 50 to 55° C., 55 to 65° C., 65 to 75° C., 75 to 85° C., 85 to 95° C., 95 to 105° C., 105 to 115° C., 115 to 125° C., 125 to 135° C., 135 to 145° C., 145 to 155° C., 155 to 165° C., and 165 to 175° C. The reaction conditions at block 202 can further include a reaction pressure of 30 to 50 bar and all ranges and values there between including ranges of 30 to 32 bar, 32 to 34 bar, 34 to 36 bar, 36 to 38 bar, 38 to 40 bar, 40 to 42 bar, 42 to 44 bar, 44 to 46 bar, 46 to 48 bar, and 48 to 50 bar. The reaction conditions at block 202 can include a hydrogen partial pressure of 20 to 30 bar and all ranges and values there between including ranges of 20 to 21 bar, 21 to 22 bar, 22 to 23 bar, 23 to 24 bar, 24 to 25 bar, 25 to 26 bar, 26 to 27 bar, 27 to 28 bar, 28 to 29 bar, and 29 to 30 bar. The reaction conditions at block 202 can include a superficial velocity of 1 to 5 m/s and all ranges and values there between including ranges of 1 to 2 m/s, 2 to 3 m/s, 3 to 4 m/s, and 4 to 5 m/s.

According to embodiments of the invention, as shown in block 203, method 200 includes separating, in separation unit 110, hydrogenated intermediate stream 15 to remove $C_4$− (non-condensables) to $C_{5-8}$ hydrocarbons, from hydrogenated intermediate stream 15 to produce wash oil stream 16, which is configured to remove fouling from a compressor. In embodiments of the invention, wash oil stream 16 comprises more than 90 wt. % aromatics, preferably 90 to 98 wt. % aromatics and all ranges and values there between including ranges of 90 to 91 wt. %, 91 to 92 wt. %, 92 to 93 wt. %, 93 to 94 wt. %, 94 to 95 wt. %, 95 to 96 wt. %, 96 to 97 wt. %, and 97 to 98 wt. %. Wash oil stream 16, in embodiments of the invention, can have a gum content of 0.2 to 1.5 wt. % and all ranges and values there between including ranges of 0.2 to 0.3 wt. %, 0.3 to 0.4 wt. %, 0.4 to 0.5 wt. %, 0.5 to 0.6 wt. %, 0.6 to 0.7 wt. %, 0.7 to 0.8 wt. %, 0.8 to 0.9 wt. %, 0.9 to 1.0 wt. %, 1.0 to 1.1 wt. %, 1.1 to 1.2 wt. %, 1.2 to 1.3 wt. %, 1.3 to 1.4 wt. %, and 1.4 to 1.5 wt. %.

In embodiments of the invention, as shown in block 204, separating at block 203 can include separating, in $C_4$ column 104, hydrogenated intermediate stream 15 to produce $C_5$+ stream 17 comprising primarily $C_5$+ hydrocarbons. Separating at block 204 can further produce a $C_4$− stream comprising primarily $C_4$− hydrocarbons. In embodiments of the invention, at block 204, $C_4$ column 104 is operated at an overhead temperature range of 60 to 90° C. and a bottom boiling range of 130 to 150° C. At block 204, $C_4$ column 104 can be operated at an operating pressure of 4 to 9 barg.

In embodiments of the invention, as shown in block 205, separating at block 203 can include separating, in $C_5$ column 105, $C_5$+ stream 17 to produce $C_6$+ stream 18 comprising primarily $C_6$+ hydrocarbons. Separating at block 205 can further produce a $C_5$ stream comprising primarily $C_5$ hydrocarbons. In embodiments of the invention, at block 205, $C_5$ column 105 is operated at an overhead temperature range of 60 to 80° C. and a bottom boiling range of 110 to 140° C. At block 205, $C_5$ column 105 can be operated at an operating pressure of 1 to 3 barg.

In embodiments of the invention, as shown in block 206, separating at block 203 can include separating, in $C_6$ column 106, $C_6$+ stream 18 to produce $C_7$+ stream 19 comprising primarily $C_7$+ hydrocarbons. Separating at block 206 can further produce a $C_6$ stream comprising primarily $C_6$ hydrocarbons. In embodiments of the invention, at block 206, $C_6$ column 106 is operated at an overhead temperature range of 80 to 100° C. and a bottom boiling range of 140 to 165° C. At block 206, $C_6$ column 106 can be operated at an operating pressure of 1 to 3 barg.

In embodiments of the invention, as shown in block 207, separating at block 203 can include separating, in $C_8$ column 107, $C_7$+ stream 19 to produce wash oil stream 16 comprising the wash oil. Separating at block 207 can further produce a $C_7$ to $C_8$ stream comprising primarily $C_7$ and $C_5$ fractions, collectively. In embodiments of the invention, at block 207, $C_5$ column 107 is operated at an overhead temperature range of 70 to 90° C. and a bottom boiling range of 140 to 170° C. At block 207, $C_5$ column 107 can be operated at an operating pressure of 0.01 to 0.2 bara (vacuum operated column). The wash oil of wash oil stream 16 is configured to remove fouling from a compressor. The compressor can include a cracked gas compressor. The wash oil may be configured to remove fouling from compressor internals and/or interstage coolers of the compressor. The wash oil may be configured to remove fouling from a heat exchanger, soak fouled equipment, and/or flush fouled equipment. The heat exchanger can include a heat exchanger of a quench tower top loop. The fouling can comprise one or more polymers formed by unsaturated hydrocarbons, indene, (methyl)-styrene, butadiene, dicyclopentadiene (DCPD), (methyl)-indene, Diels-Alder polymerization, or combinations thereof.

Although embodiments of the present invention have been described with reference to blocks of FIG. 2 should be appreciated that operation of the present invention is not limited to the particular blocks and/or the particular order of the blocks illustrated in FIG. 2. Accordingly, embodiments of the invention may provide functionality as described herein using various blocks in a sequence different than that of FIG. 2.

The systems and processes described herein can also include various equipment that is not shown and is known to one of skill in the art of chemical processing. For example, some controllers, piping, computers, valves, pumps, heaters, thermocouples, pressure indicators, mixers, heat exchangers, and the like may not be shown.

In the context of the present invention, at least the following 16 embodiments are described. Embodiment 1 is a method of processing a light fuel oil. The method includes hydrogenating the light fuel oil to produce a hydrogenated light fuel oil. The method further includes separating, in a separation unit, the hydrogenated light fuel oil to produce a wash oil stream.

Embodiment 2 is a method of processing a cracked distillate. The method includes hydrogenating the cracked distillate and diluent containing pyrolysis gas in a hydrogenation unit to produce a hydrogenated intermediate stream. The method further includes separating, in a separation unit, the hydrogenated intermediate stream to remove $C_4$ to $C_6$ hydrocarbons, toluene and xylene from the hydrogenated intermediate stream to produce a wash oil stream configured to remove fouling from equipment. Embodiment 3 is the method of any of embodiments 1 and 2, wherein the equipment includes a compressor, a heat exchanger, or combinations thereof. Embodiment 4 is the method of any of embodiments 1 to 3, wherein the hydrogenating step is configured to saturate unsaturated hydrocarbons of the cracked distillate. Embodiment 5 is the method of any of embodiments 1 to 4, wherein the separation unit includes one or more distillation columns. Embodiment 6 is the method of any of embodiments 1 to 5, wherein the compressor includes a cracked gas compressor. Embodiment 7 is the method of any of embodiments 1 to 6, wherein the fouling contains one or more polymers formed by unsaturated hydrocarbons, indene, (methyl)-styrene, butadiene, dicyclopentadiene (DCPD), (methyl)-indene, or combinations thereof. Embodiment 8 is the method of any of embodiments 1 to 7, wherein the cracked distillate is produced via steam cracking of hydrocarbons. Embodiment 9 is the method of any of claims 1 to 8, wherein the cracked distillate contains 90 to 95 wt. % aromatics. Embodiment 10 is the method of any of embodiments 1 to 9, wherein the wash oil stream contains 90 to 99 wt. % aromatics. Embodiment 11 is the method of any of embodiments 1 to 10, wherein the pyrolysis gas is produced via condensation of cracked gas in quench water tower or cracked gas compressor. Embodiment 12 is the method of any of embodiments 1 to 11, wherein the cracked distillate and the pyrolysis gas stream are flowed into the hydrogenation unit at a weight flow rate ratio of 1:80 to 1:50. Embodiment 13 is the method of any of embodiments 1 to 12, wherein the hydrogenation unit is operated at an operating temperature of 50 to 175° C. Embodiment 14 is the method of any of embodiments 1 to 13, wherein the hydrogenation unit is operated at an operating pressure of 30 to 50 bar. Embodiment 15 is the method of any of embodiments 1 to 14, wherein the wash oil is configured to rinse off fouling from compressor internals and/or interstage coolers of a crack gas compressor. Embodiment 16 is the method of any of embodiments 1 to 15, wherein the diluent is configured to reduce negative impact of the cracked distillate on a catalyst used in the hydrogenating step.

All embodiments described above and herein can be combined in any manner unless expressly excluded.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method of processing a light fuel oil, the method comprising:

hydrogenating the light fuel oil to produce a hydrogenated intermediate stream; and separating, in a separation unit, the hydrogenated intermediate stream to produce a C7+ stream; and separating, in a C8 column, the C7+ stream to produce: a C7 to C8 fraction stream comprising toluene, p-, m-, and o-xylenes, and ethylbenzene and a wash oil stream comprising 90 to 99 wt. % aromatics.

2. A method of processing a cracked distillate comprising 90 to 95 wt. % aromatics, the method comprising:

hydrogenating the cracked distillate and diluent comprising pyrolysis gas in a hydrogenation unit to produce a hydrogenated intermediate stream; and separating, in a separation unit, the hydrogenated intermediate stream to remove $C_4$ to $C_6$ hydrocarbons, toluene and xylene from the hydrogenated intermediate stream to produce a wash oil stream configured to remove fouling from equipment, wherein the wash oil stream comprises 90 to 99 wt. % aromatics.

3. The method of claim 2, wherein the wash oil stream is configured to remove fouling from a compressor, a heat exchanger, or combinations thereof.

4. The method of claim 2, wherein the hydrogenating step is configured to saturate unsaturated hydrocarbons of the cracked distillate.

5. The method of claim 2, wherein the separation unit comprises one or more distillation columns.

6. The method of claim 2, wherein the compressor includes a cracked gas compressor.

7. The method of claim 2, wherein the wash oil stream is configured to remove fouling comprising one or more polymers formed by unsaturated hydrocarbons, indene, (methyl)-styrene, butadiene, dicyclopentadiene (DCPD), (methyl)-indene, or combinations thereof.

8. The method of claim 2, wherein the cracked distillate is produced via steam cracking of hydrocarbons.

9. The method of claim 2, wherein the pyrolysis gas is produced via condensation of cracked gas in quench water tower or cracked gas compressor.

10. The method of claim 2, wherein the cracked distillate and the pyrolysis gas stream are flowed into the hydrogenation unit at a weight flow rate ratio of 1:80 to 1:50.

11. The method of claim 2, wherein the hydrogenation unit is operated at an operating temperature of 50 to 175° C.

12. The method of claim 2, wherein the hydrogenation unit is operated at an operating pressure of 30 to 50 bar.

13. The method of claim 2, further comprising contacting wash oil from the wash oil stream to rinse off fouling from compressor internals and/or interstage coolers of a crack gas compressor.

14. The method of claim 2, wherein the diluent is configured to reduce negative impact of the cracked distillate on a catalyst used in the hydrogenating step.

15. The method of claim 3, wherein the diluent is configured to reduce negative impact of the cracked distillate on a catalyst used in the hydrogenating step.

16. The method of claim 4, wherein the diluent is configured to reduce negative impact of the cracked distillate on a catalyst used in the hydrogenating step.

17. The method of claim 5, wherein the diluent is configured to reduce negative impact of the cracked distillate on a catalyst used in the hydrogenating step.

18. The method of claim 6, wherein the diluent is configured to reduce negative impact of the cracked distillate on a catalyst used in the hydrogenating step.

19. The method of claim 1, wherein the separation unit is operates at an overhead temperature range of 70 to 90° C., a bottom boiling range of 140 to 170° C., and an operating pressure of 0.01 to 0.2 bara as a vacuum operated column.

20. The method of claim 2, wherein the toluene and xylene are removed in the separation unit operating at an overhead temperature range of 70 to 90° C., a bottom boiling range of 140 to 170° C., and an operating pressure of 0.01 to 0.2 bara as a vacuum operated column.

* * * * *